US005857789A

United States Patent [19]

Day et al.

[11] Patent Number: 5,857,789

[45] Date of Patent: Jan. 12, 1999

[54] TAPE PRINTER FOR BAR CODE PRINTING

[75] Inventors: Robert Charles Lewis Day, Fulbourn; Tony Dunn, Royston; Martin Edwards, West Wratting, all of United Kingdom; Stijn Jans, Neerpelt, Belgium

[73] Assignee: Esselte NV, Sint-Niklaas, Belgium

[21] Appl. No.: 778,223

[22] Filed: Jan. 8, 1997

[30] Foreign Application Priority Data

Feb. 14, 1996 [DE] Germany ..... 296 02 534 U

[51] Int. Cl.[6] ..... B41J 3/46

[52] U.S. Cl. ..... 400/615.2; 400/70; 400/83; 400/103

[58] Field of Search ..... 400/615.2, 103, 400/70, 61, 76, 83

[56] References Cited

U.S. PATENT DOCUMENTS 4,815,871 3/1989 McGourty et al. .
4,927,278 5/1990 Kuzuya et al. .
4,966,476 10/1990 Kuzuya et al. .
5,496,117 3/1996 Sawada et al. ..... 400/586

*Primary Examiner*—John Hilten
*Attorney, Agent, or Firm*—Pennie & Edmonds LLP

[57] ABSTRACT

The invention relates to a printer which can print both text and bar code data on an elongated web-like tape. The printer is provided with a display having a first display mode in which both text data and bar code data are displayed. A bar code display unit is provided to advise the user when the cursor is assigned to bar code data in the first display mode. A second display mode can also be provided. In the second display mode, only the bar code data is displayed and only it can be entered and edited. When characters comprising either text data or bar code data are entered, they are placed sequentially in an input buffer, which comprises a first area of a storage device. The start and end positions of the bar code data within the input buffer are stored in a second area of the storage device. During printing operations, the position of each character in the input buffer is compared to the start and end positions to determine whether that particular character is to be printed as text or as a bar code.

33 Claims, 7 Drawing Sheets

TAPE PRINTER FOR BAR CODE PRINTING

TECHNICAL FIELD

This invention relates to a tape printing apparatus and, is particularly concerned with a tape printing apparatus capable of bar code printing.

BACKGROUND

Tape printing devices of the type to which this invention pertains are disclosed in U.S. Pat. Nos. 4,927,278 & 4,966,476, assigned to Brother KK, and also in U.S. Pat. No. 4,815,871 assigned to Varitronic. The printers each include a printing device with a cassette receiving bay for receiving a cassette or tape holding case. In the '871 patent, the tape holding case houses an ink ribbon, a transparent image receiving tape and a double-sided adhesive tape which is secured at one of its adhesive coated sides to the image tape after printing, with a backing paper which can be peeled from its other adhesive side. With both of these devices, the image transfer medium (ink ribbon) and an image receiving tape (substrate) are in the same cassette.

Another type of tape printing device is described, for example, in U.S. Pat. No. 5,458,423, the contents of which are incorporated herein by reference. With this printing device, the substrate tape is similar to that described in the '871 patent, but is housed in its own tape holding case and the ink ribbon is also housed in its own tape holding case.

In all these cases, the image receiving tape overlaps with the ink ribbon and passes through a print zone consisting of a fixed print head and a platen against which the print head can be pressed to transfer an image from the ink ribbon to the image receiving tape. There are many ways to do this, including dry lettering or dry film impression. At present, however, the most common method is thermal printing. In thermal printing, the print head is heated and the heat causes ink from the ink ribbon to be transferred to the ink receiving tape. Alternatively, the print head can come into direct contact with a thermally sensitive image receiving tape. Heating the print head then produces an image on the image receiving tape.

U.S. Pat. No. 5,395,173 discloses a tape printer which is capable of printing text as well as bar codes. As is known to those skilled in the art, bar codes, which typically comprise a number of lines of varying thickness, are commonly used in article identification systems. A device according to the '173 patent allows a user to type in the text data which is to be printed as ordinary text, as well as the bar code data, which is to printed out as a bar code.

The device has two modes, a normal mode and a special mode. In the normal mode, the text data is displayed as such while the bar code data is represented by specially assigned characters. Only text data can be entered in normal mode. If the user wishes to insert bar codes along with text, the user presses a bar code key. The tape printer then switches to a special mode, in which only bar code data can be entered and displayed. After the bar code data has been entered, the user presses the execution key and the printer switches back to the original, normal input and display mode. The bar code data is then stored in the printer memory, e.g., an input buffer along with the text data. The bar code data is distinguished from the text data by means of a start code and an end code, which are stored just before and after the bar code data.

One disadvantage of the prior art is that it is not possible to see both ordinary characters and bar code data simultaneously on the display. For this reason it is not possible to control both ordinary characters and bar code data at the same time. Therefore the user must switch into the special mode if he wants to control or edit the number to be printed as a bar code.

Another disadvantage is that the bar code start and end codes require valuable space in the input buffer of the printer's memory. This reduces the total number of characters which can be stored in a fixed-length input buffer.

A further disadvantage is that bar code data conversion during printing is more complicated due to the bar code start and end codes. This is because each time a character is read out of the memory, the conversion device must first determine whether the character is a bar code start code, a bar code end code, or something else. This step unnecessarily lengthens the conversion time.

SUMMARY OF THE INVENTION

One object of the invention is to provide a printer which displays both text data and bar code data at the same, while advising the user which type of data he or she is working with at any given time.

Another object of the invention is to efficiently store text data and bar code data, and obviate the need for storing bar code start codes and bar code end codes in the input buffer of the printer's memory.

Yet another object of the invention is to more efficiently convert the text and bar code data into a printed label.

These objects are achieved with a printer in accordance with the present invention. In such a printer, characters comprising text data and bar data are entered through the printer's input device. These characters are stored in an input buffer which comprises a first area in a storage device of the printer. The printer's display allows text data and bar code data to be displayed simultaneously in a first display mode. These data are displayed in their original form. The text data (characters to be printed as displayed) and the bar code data (characters to be printed as a bar code) are displayed exactly as they are entered by a user. Thus, the bar code data is neither displayed as a bar code nor represented by special characters. A cursor, controlled by an associated cursor movement device, points to a character of either type (text or bar code) to indicate where data is to be added or deleted. The printer is further provided with means for informing the user when the cursor points to bar code data and when it points to text data. The printer is also provided with a converting device which is configured to convert the text data and bar code data into printable data before they are printed onto an elongated web-like tape. Such converting devices are disclosed, for example, in aforementioned U.S. Pat. No. 5,395,173, the content of which is expressly incorporated herein by reference thereto.

In a first embodiment of the invention, the printer is provided with a bar code display unit which indicates when a cursor is assigned to a bar code character as opposed to when it is assigned to a text character. Preferably, the bar code display unit lights up when the cursor is assigned to bar code data and remains dark (i.e., does not light up) when the cursor is assigned to a text character.

The first embodiment obviates the need for additional devices or functions which inform the user which type of data is being displayed. For instance, no space is required on the display to show, for example, bar code start and end marks before and after the bar code data. This has the advantage that more data can be displayed on the same display. This is especially useful if the printer is not equipped with a high resolution display, but instead, can only show bar code data, rather than the bar codes themselves.

In a second embodiment of the invention, the printer is provided with two different display modes and one may easily switch between the two. In the first display mode, the text data and the bar code data are displayed together. In the second display mode, only bar code data is displayed and only bar code data can be entered, edited and deleted. Thus, with the printer in the second display mode, the user can focus his attention on the bar code data since the text data are not displayed.

A method for inputting data in accordance with a dual-mode display is also contemplated. The method comprises the steps of entering data, storing the entered data, and displaying both text and bar code data in a first display mode and displaying only bar code data in a second display.

One aspect of the second embodiment is that the bar code data is displayed between predetermined marks representing the beginning and end of the bar code data, when the display is in this second mode. This informs the user that he is in second display mode and therefore no text data is present.

Another aspect of the second embodiment is that an assigned bar code key can be used to switch from the first display mode to the second display mode. This key can be marked with the words 'bar code' or something similar. The assigned bar code key can also be used to switch the display of the printer from the second display mode back to the first display mode, thus toggling between the two modes. Alternatively or additionally, an 'enter' or 'return' key may be used to perform this function.

Yet another aspect of the second embodiment is that when the printer is switched from the first display mode to the second display mode, the bar code data is displayed regardless of the cursor position before the switch. This is especially useful in cases where so much text data are entered (in the first display mode) that the entire display is occupied by text data alone, even though bar code data might also be present. In other words, the display is not big enough to show both the cursor indicating where the text data can be entered or deleted, as well as the bar code data. If, under these circumstances, the user switches to the second display mode, it is desirable to instantly see the bar code data.

Still another aspect of the second embodiment is that upon return to the first display mode from the second display mode, the cursor is positioned immediately after the bar code data regardless of where in the bar code data the cursor was positioned while in the second display mode. This is because it would be pointless to switch from the second display mode back to the first display mode and find the cursor in the middle of bar code data, as one presumably has just edited the bar code data in the second display mode. Upon return to the first display mode, the only useful position for the cursor is outside the bar code data and preferably to its right. Therefore, upon return to the first display mode, the cursor is placed either under the first text character after the bar code data or to the right of the bar code data, should no text character present in that position.

In a refinement of the second embodiment, only text data can be entered, edited and deleted in the first display mode and only bar code data may be entered, edited and deleted in the second display mode. Providing mutually exclusive functions in the two display modes simplifies the use of the printer.

The cursor position can be saved when switching from the first display mode to the second display mode and bar code data can be inserted at this position. The bar code data entered in the second display mode are then stored in the input buffer, along with the text data entered while in the first display mode. Typically, the text data has previously been entered. When one switches back to the first display mode, the bar code data is displayed beginning where the cursor was positioned immediately before entering the second display mode. More text data can then be added. The additional text data is simply added in the input buffer after the bar code data.

Also, it can arranged so that bar code data cannot be entered at the saved cursor position if a bar code has previously been entered at a different position in the text data. This ensures that a single label will not have more than one bar code.

In a third embodiment of the present invention, bar code position data is stored at a predetermined second area in the storage device which is different from the first area. The bar code position data indicates where in the input buffer the bar code data is stored. This predetermined second area does not overlap with the input buffer. Thus, the bar code position data does not require any space in the input buffer where the characters are stored.

A method for controlling text data and bar code in a printer, wherein these data are stored in a first area and bar code position data is stored in a second area, is contemplated. The method includes the steps of entering the text and bar code data, storing the data in a first area, storing bar code position information in a second area, the bar code position information indicating where in the first area, the bar code data is stored, converting the text data and bar code data into printable characters, and then printing the printable characters onto a tape.

One aspect of the third embodiment is that the bar code position data indicate the positions of the first and last bar code characters in a sequence of bar code data in the input buffer.

Another aspect of the third embodiment is that, during printing, a converting device is configured to read text data and bar code data sequentially out of the storage device. The converting device is also configured to check the bar code position data before converting it into printable data. If the bar code position data indicates that no bar codes are to be printed, there is no need to check which data in the input buffer is to be converted into bar codes and which is not. Thus, the conversion operation is carried out faster when a label without bar codes is printed. Otherwise, the converting device decides, based on the bar code position data, whether data read out of the storage means is to be printed as bar codes or as text. In cases where the bar code position data indicates the first and last positions of the bar code data, the position of each character read out is compared with the stored positions of the first and last bar code characters.

DETAILED DESCRIPTION OF THE PREFERRED EMBODIMENT

Figure 1:
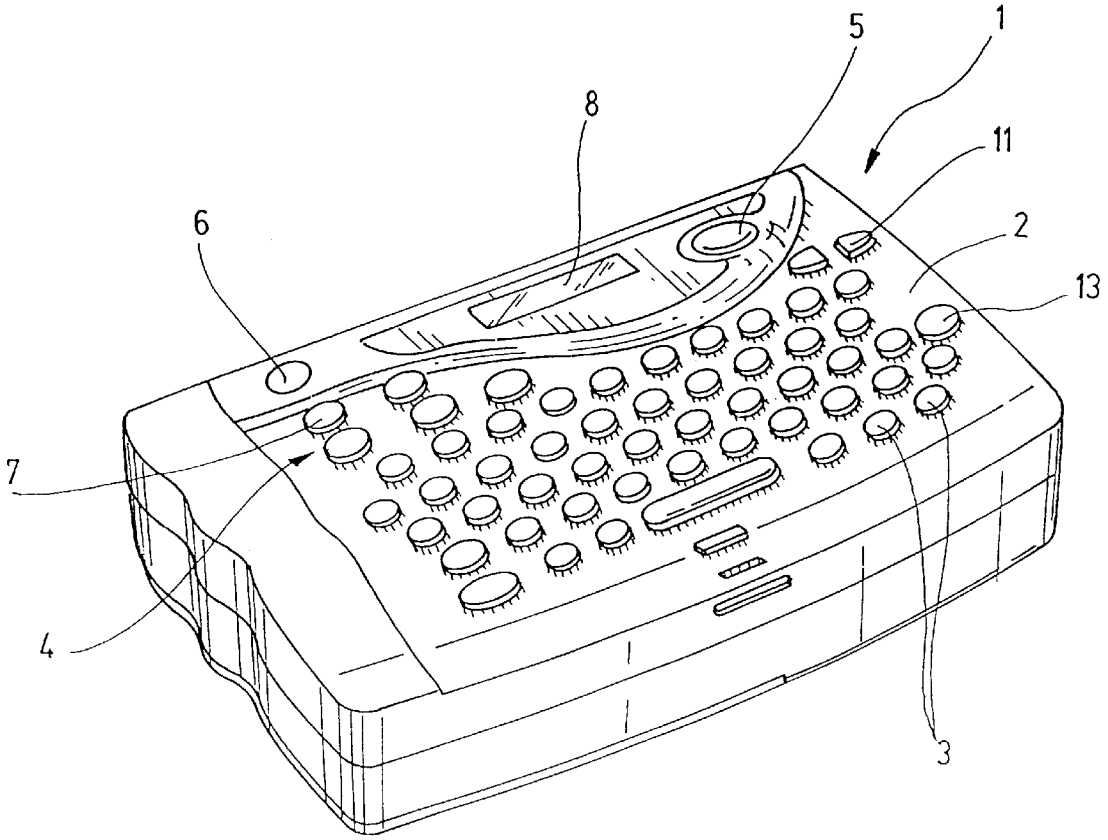
FIG. 1 is a perspective view of the front of a tape printing apparatus.

FIG. 1 shows a simplified plan view of a tape printing apparatus 1. The tape printing apparatus includes a keyboard 2 and a display 8.

The keyboard 2 has a variety of data entry keys including a number of alphanumeric and punctuation keys 3 for entering data to be printed as a label. It also has a number of function keys 4 for editing the data entered. These function keys 4 are used, for example, to change the size or font of the input data, and also to underline and frame a label.

The keyboard 2 also comprises a number of other control keys. Among these are an on/off key 6 for switching the tape printing apparatus 1 on and off and a print key 5 which is operated when a label is to be printed. Cursor keys 11, which move a cursor over the display 8, are also provided, as is an 'enter' or 'return' key 13. A bar code key 7 is also provided to assist users of the tape printing apparatus 1 to produce labels with bar codes.

The display 8 is preferably a liquid crystal display. It displays data as it is entered. However, the display may not be large enough to display, at one time, all the data entered. Thus, the display 8 allows the user to view all or part of the label to be printed. This facilitates editing of the label prior to printing. In addition, the display 8 can also display messages to the user, for example, error messages or an indication that the print key 5 was pressed. The display 8 is driven by a display driver 38, depicted in FIG. 3.

Figure 2:
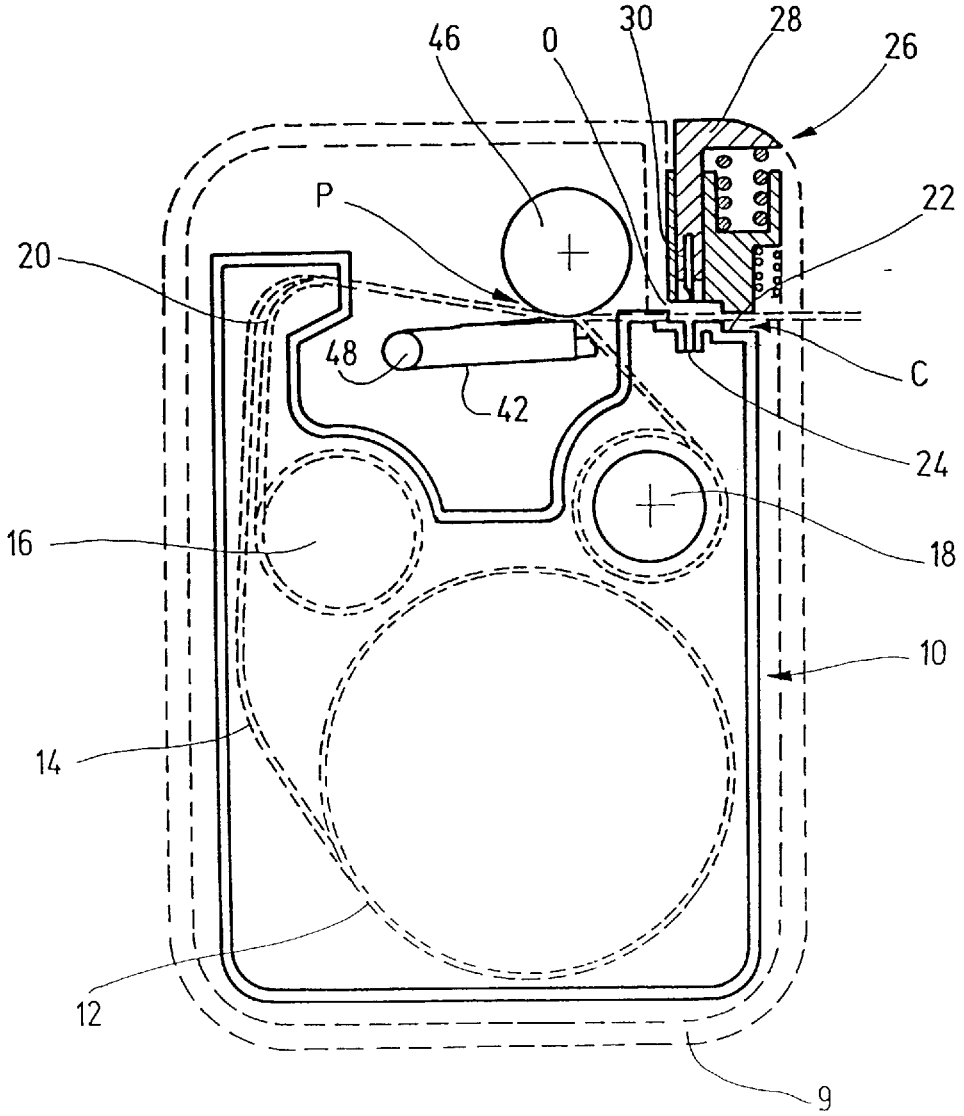
FIG. 2 is a plan view of the underside of the tape printing apparatus of FIG. 1.

As shown in FIG. 2, the tape printing apparatus 1 is provided with a cassette receiving bay. The cassette receiving bay includes a thermal print head 42 and a platen 46 which act in combination to define a print zone P. The print head 42 can swivel around a pivot point 48 so that it can be brought into contact with the platen 46, allowing a cassette 10 to be removed and replaced.

The cassette 10 holds a supply spool 12 of image receiving tape 14. The image receiving tape 14 comprises an upper layer for receiving a printed image on one surface while its other surface is coated with an adhesive layer secured to a removable backing layer. The image receiving tape 14 is guided through the cassette 10 past the print zone P and ultimately exits the cassette 10 through an outlet 0 from where it proceeds to a cutting location C.

The cassette 10 is also provided with an ink ribbon supply spool 16 and ink ribbon take up spool 18. The image receiving tape 14 and the ink ribbon 20 are arranged to overlap and pass between the print head 42 and the platen 46, so that the image receiving layer of the image receiving tape 14 comes into contact with the ink ribbon 20.

The platen 46 shown in FIG. 2 is driven by a motor 31 under the control of the microprocessor 44. The motor 31 is preferably a stepper motor, although a conventional DC motor without stepping capabilities can also be used. The motor 31 drives the image receiving tape 14 through the print zone P. When a stepper motor is provided, the platen 46 gradually rotates to drive the image receiving tape 14 in successive stages through the print zone P during the printing operation. When, instead, a non-stepper motor is provided, the image receiving tape 14 is driven continuously through the print zone P during printing.

An image is printed on the image receiving tape 14 and the image receiving tape 14 is fed from the print zone P to the cutting location C at the side portion 22 of the wall of the cassette 10. A slot 24 is defined in the side portion 22. The image receiving tape 14 is fed past the print zone P to the cutting location C where it is supported by facing side sections on both sides of the slot 24. A cutting mechanism 26 having a cutting support member 28 and a blade 30 is used to cut the tape 14. In the cutting process, the blade 30 moves towards the image receiving tape 14, cuts it, and then is received in the slot 24.

The print head 42 is preferably a thermal print head comprising a column with a multitude of printing elements. The print head 42 is preferably only one printing element wide with the column extending in a direction perpendicular to the lengthwise direction of the image receiving tape 14. The height of the column of printing elements is substantially equal to the width of the image receiving tape 14 to be used with the label printing apparatus 1. Where more than one width of image receiving tape 14 is used, the height of the print head column is generally equal to the largest width of tape 14.

An image is printed column by column on the image receiving tape 14 by the print head 42. It should be noted that an image can be printed on the image receiving tape 14 via the ink ribbon 20. Alternatively, if the image receiving tape 14 has a suitable thermally sensitive material, an image can be applied directly by the print head 42 to the image receiving tape 14, without using a ribbon 20.

As an alternative to the one cassette system shown in FIG. 2, the cassette receiving bay may be arranged to receive separate image receiving and ink ribbon cassettes which are arranged so that the ink ribbon and the image receiving tape are overlapped and pass through a print zone. This particular cassette arrangement is described for example in aforementioned U.S. Pat. No. 5,458,423, the contents of which have been incorporated herein by reference. Any other suitable arrangement for providing a supply of image receiving tape can, of course, be used with the embodiments of this invention.

Figure 3:
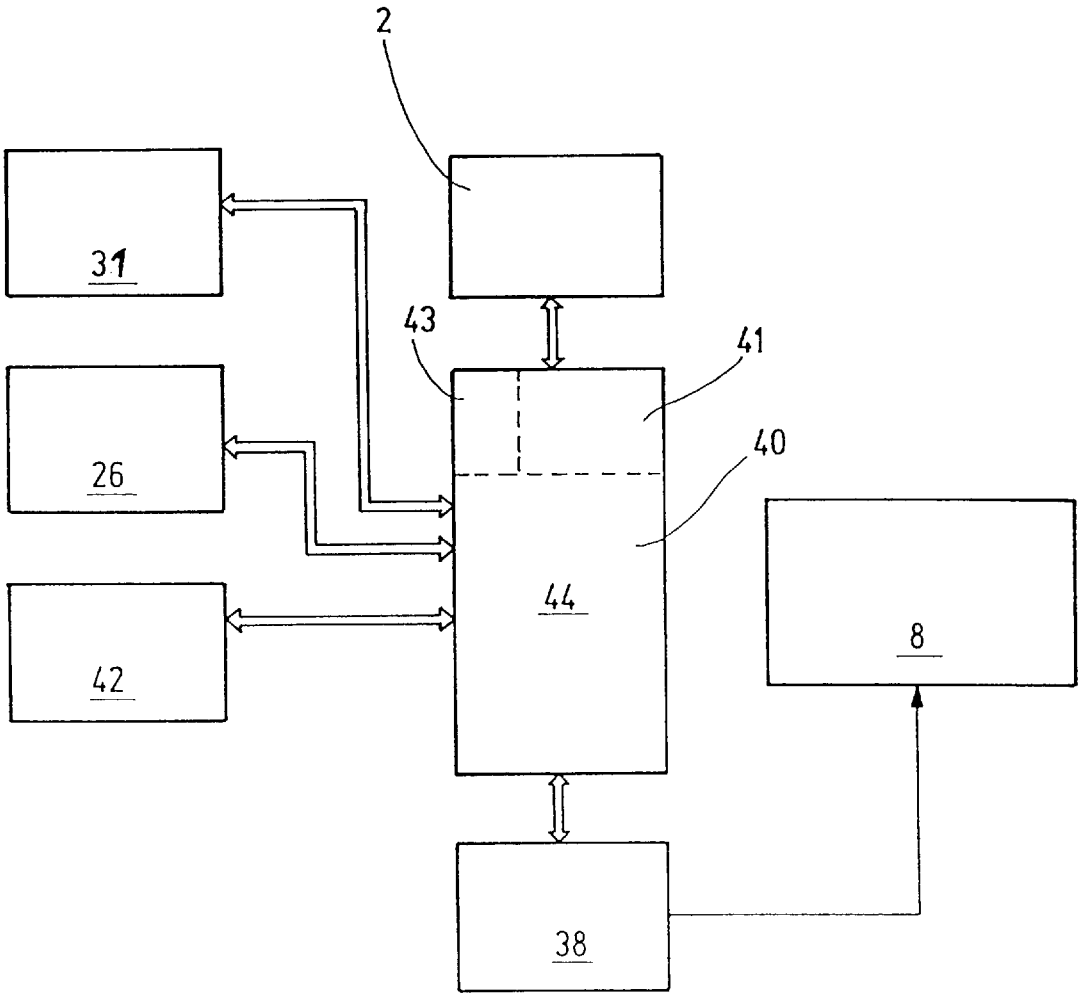
FIG. 3 is a block diagram of a controller for controlling the tape printing apparatus of FIG. 1.

FIG. 3 shows a microprocessor-based controller 40 for controlling the tape printing apparatus 1 of FIGS. 1 and 2. In the preferred embodiment, the controller 40 includes a microprocessor 44, a read only memory (ROM) 41, and a random access memory (RAM) 43. The microprocessor 44 is driven by programming stored in the ROM 41. The controller 40 is configured by programming in the ROM to control the various devices to which the controller is connected.

The controller 40 is connected to the input device, preferably a keyboard 2, in order to receive entered label data. It also outputs data to the display 8 via the display driver 38 so as to display a label, or a part thereof, to be printed. Messages and/or instructions to the user are also sent by the controller 40 to the display 8. Additionally, the controller 40 outputs data to drive the print head 42, which prints an image onto the image receiving tape 14 to form a label. The controller 40 also controls the motor 31, which drives the image receiving tape 14 through the tape printing apparatus 1 and controls the cutting mechanism 26 to allow lengths of image receiving tape 14 to be cut off after an image has been printed on it.

The label printing apparatus 1 allows labels to be composed and displayed on the display 8 using the various keys. The ROM 41 stores information relating to characters and the like which are associated with the respective keys 3, as well as functions associated with the function keys 4.

When a key 3 is pressed, data related to the associated character or the like is retrieved from the ROM 41 and then stored in the RAM 43. The data stored in the RAM 43 may be in the form of a code which identifies the character. The microprocessor 44 then generates pixel data which corresponds to the data stored in the RAM 43. These data are transmitted column by column to the print head 42 and, in another form, to display 8.

Similarly, when a function key 4 is pressed, related data is retrieved from the ROM 41. This data may take the form of a flag. The pixel data generated by the microprocessor 44 and sent to the print head 42 and the display 8 will take into account the data corresponding to one or more functions stored in the RAM 43. Keys 3 and 4 of the keyboard 2 have predetermined associated functions which cause predetermined data associated with these functions to be retrieved from ROM 41.

Figure 4:
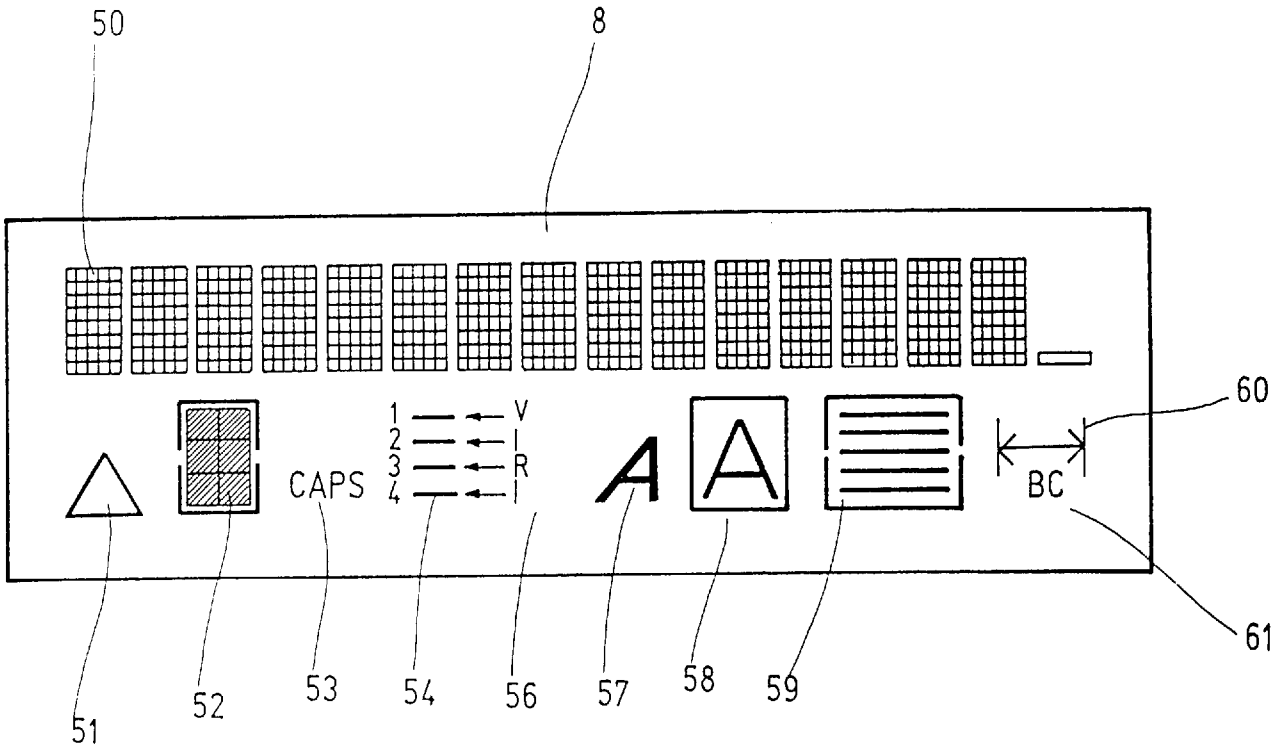
FIG. 4 is plan view of the display of the tape printing apparatus of FIG. 1.

FIG. 4 shows the display 8 of the tape printing apparatus 1. It comprises an upper line of fields 50, each of which is designed to display a single character. The cursor, which can be moved over the fields 50 by means of the cursor keys 11, is indicated, e.g., by means of a blinking, inverted or underlined field so that the user can easily recognize which position among the displayed characters he is currently working on.

On the lower portion of the display 8 are a multitude of display units whose function is now described. The triangle 51 lights up when upper case is selected and the field 52 indicates the size of the character. The symbol 53 indicates that the Caps key has been pressed. When the display 8 is in multiple line mode, symbol 54 indicates which line number is being shown on the display 8. Symbol 56 indicates a 90° rotation of the characters; symbol 57 indicates italics; and symbol 58 indicates a frame around the printed matter on the label. Symbol 59 indicates justification of the printed matter (full, left, center, right) and symbol 60 indicates that a fixed length mode has been selected.

Symbol 61 is a bar code display unit which comprises a light. When the cursor is assigned to bar code data which ultimately will be printed as a bar code, the light is illuminated, thus indicating to the user that it is assigned to the bar code data. As is know to those skilled in the art, bar code data are converted and printed as bar codes, but displayed in the original un-converted form as entered. As the user scrolls the cursor over the upper line of fields 50, the bar code display unit will not be illuminated when the cursor is assigned to text data which is to be printed as displayed.

Figure 5:
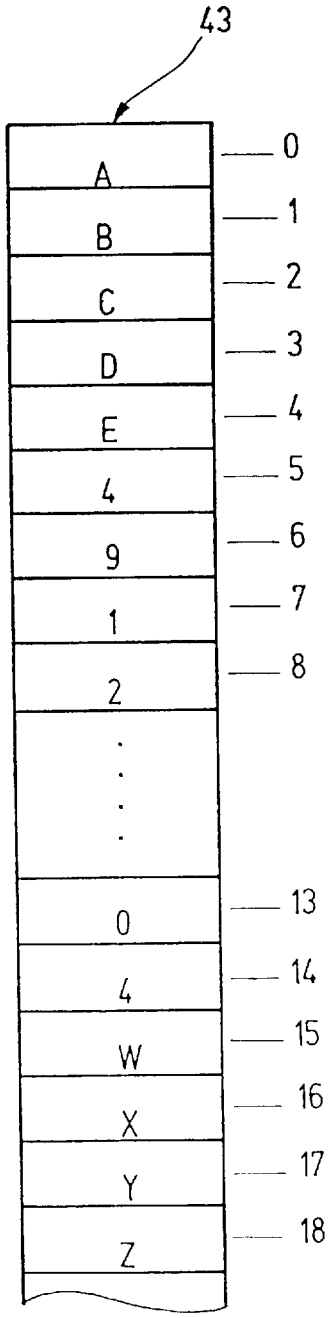
FIG. 5 illustrates the input buffer.

FIG. 5 illustrates how the data entered is stored in the input buffer of the RAM 43. The input buffer occupies a first area in RAM 43. Order numbers of the stored positions in the input buffer are given to the right of the buffer segments. As text data and bar code data entered, they are stored sequentially in the input buffer. In the example of FIG. 5, the segment with the text character 'A' is order number 0, the segment storing the text character 'B' is order number 1 and so on. Segments 5 to 14 contain numbers which, for this example, are assumed to be bar code data.

Bar code position data, which identifies where in the input buffer the bar code data resides, is not stored in the input buffer. Instead, it is stored in a predetermined second area in the RAM 43. The bar code position data comprises a bar code start position and a bar code end position. Since segments 5 to 14 are bar code data, the bar code start position is 4 (after the 'E') and the bar code end position is 14 (the last position in which bar code data is stored).

The bar code start and end positions are used during printing. If there is no bar code present in the label, both of these positions will be zero. If a bar code is present in the label, the bar code end position will have a non-zero value. To determine whether a bar code is to be printed in a label, one must check the bar code end position, rather than the bar code start position. This is because a bar code could be inserted in the label starting at position zero. Both the bar code start position and the bar code position should be set to zero when a bar code is deleted, and also just before creating a new label having bar code data.

The conversion procedure during printing is straightforward. The bar code end position is checked to determine if it is zero. If it is zero, no bar code is to be printed, and the contents of the input buffer are read sequentially and printed out as text. If the bar code end position is not zero, the contents of the input buffer are still read sequentially. If, however, the position of a character read out of the input buffer is between the bar code start position and the bar code end position, that character is printed out as a bar code in accordance with known procedures.

Figure 6A:
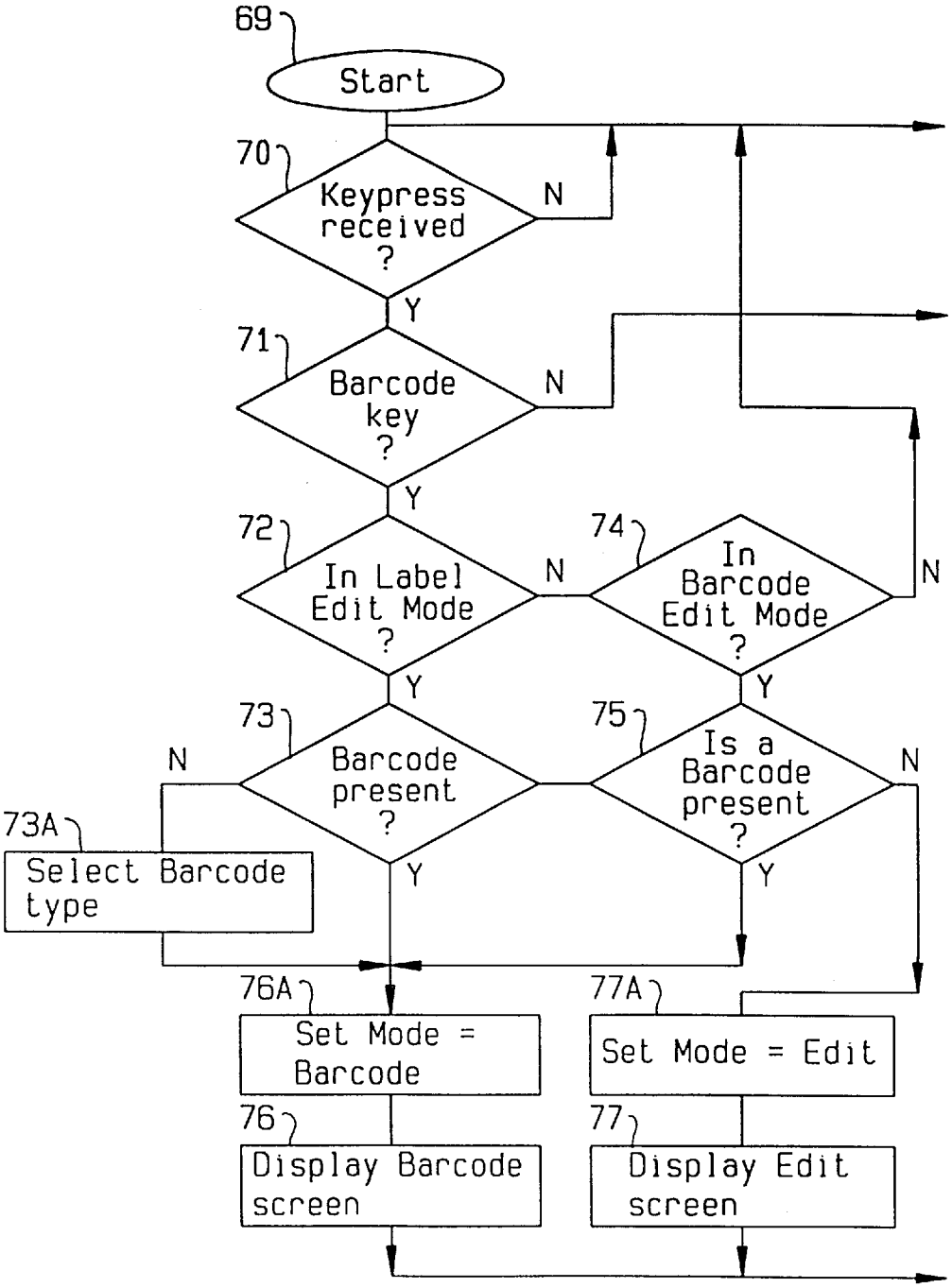
FIGS. 6A and 6B present a flow chart illustrating the bar code inputting operation.
Figure 6B:
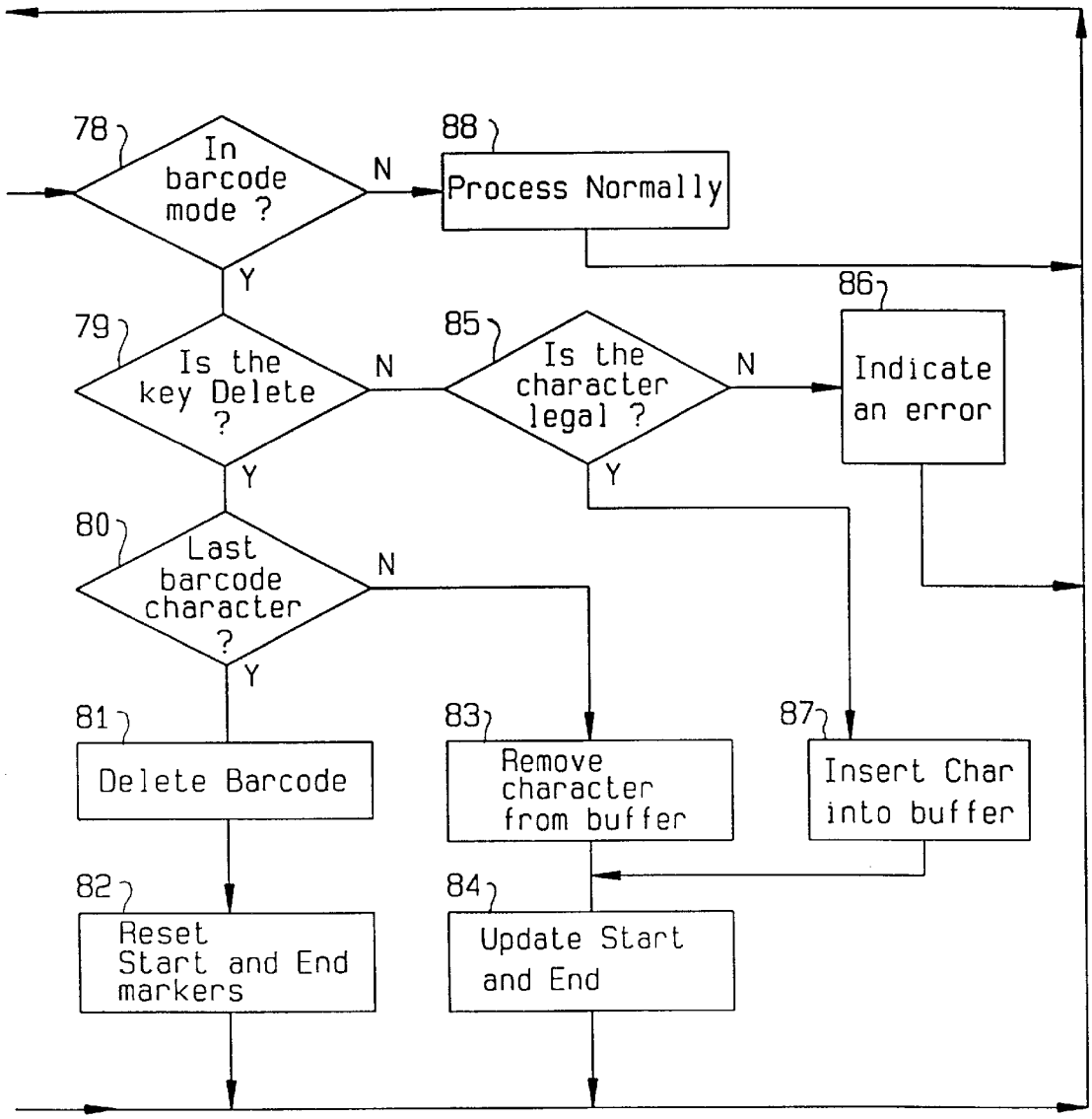

FIGS. 6A and 6B present a flow chart which illustrates how the printer display is controlled using a device made in accordance with the present invention.

Control passes to step 70 when the device commences data entry mode, as indicated by step 69. Step 70 determines whether the user pressed one of the keys 3 on the keyboard 2. If no key was pressed, control loops back to step 70. If a key was pressed, control passes to step 71.

Step 71 determines whether the key that was pressed was the bar code key 7. If the bar code key 7 was pressed, then step 72 is executed. Otherwise, control passes to step 78, described further below.

Step 72 determines whether the tape printer is in label edit mode, i.e., in the first display mode. In the first display mode, both text data and bar code data are displayed. If the printer is in the first display mode, step 73 is executed. Otherwise, step 74 is executed.

Step 73 determines whether bar code data has already been entered. If no bar code data has been entered yet, the bar code type (e.g. EAN) is selected in step 73A, and only then is the printer set to bar code mode, i.e., the second display mode in step 76A. If, on the other hand, step 73 determines that bar code data has previously been entered, the bar code type need not be set and the printer is directly set to the second display mode, in which only bar code data is displayed and edited. In either case, control passes to step 76, in which only the bar code data is displayed.

Step 76 displays the bar code data on the display 8. The bar code data can be displayed between predetermined marks. The user can then enter, edit, or delete bar code data. Thus, pressing the bar code key 7, when in the first display mode, switches the printer display to the second display mode.

Step 74 determines whether the printer is in the second display mode. If it is, step 75 is then executed.

Step 75 determines whether bar code data is present in the second display mode. If bar code data is present, the printer is set to bar code mode in step 76A, and control again passes to step 76. If, however, step 75 determines that no bar code data is present while in the second display mode, the printer is set to edit mode, i.e., the first display mode, in step 77A and control passes to step 77 wherein both text data and bar code data are displayed. Thus, pressing the bar code key 7, when in the second display mode, switches one to the first display mode if no bar code is present.

After either step 76 or step 77 is executed, control loops back to step 70.

Step 78 is executed whenever step 71 determines that the key that was pressed was not the bar code key 7. Step 78 determines whether the printer is in the second display mode. If the printer is not in the second display mode, the key is processed normally, i.e., no steps involving bar code operations are performed, represented by step 88, after which control loops backs to step 70 to await another key stroke. If, on the other hand, step 78 determines that the printer is in the second display mode, step 79 is carried out.

Step 79 determines whether the key pressed was a delete key. If so, control passes to step 80 to process the delete key. If not, control passes to step 85 to process all other keys.

Step 80 determines whether the cursor is assigned to the last character in the bar code data. If so, the delete key signifies that all the bar code data should be deleted and so control passes to step 81. If not, the delete key signifies that only that character pointed to by the cursor should be deleted, and so control passes to step 83.

Step 81 deletes all the bar code data, after which the bar code start position and the bar code end position, which track the position of the bar code data in the input buffer shown in FIG. 5, are reset to zero in step 82. As stated above, these bar code position data are stored in a second area in RAM 43.

Step 83 is executed if the cursor is not assigned to the last character of the bar code data. Step 83 removes the character assigned to the cursor from the input buffer, and then step 84 updates the bar code start and end positions. After either resetting in step 82 or updating in step 84, control loops back to step 70.

Step 85 is executed if, in step 79, the key pressed was not the delete key. Step 85 determines whether the character is legal, i.e. whether it constitutes an authorized bar code character. If the character is not legal, step 86 is executed to display an error and control loops back to step 70. If, on the other hand, the character is legal, step 87 inserts the character into the input buffer resident in the RAM 43. This is then followed by step 84, which updates the bar code position data, after which control again loops back to step 70 to await another keystroke.

An example of how bar code data is entered and displayed when the text data and bar code data can only be entered in different display modes is now presented. In this example, it is assumed that the user wants to print a label having both a bar code and text on one line which reads "beans01234567M&E". In this example, the numbers are to be printed as a bar code.

To carry this out in accordance with the present invention, the user would take the following steps, having the stated effects:

1) Enter the word 'beans' while in the first display mode. This word is echoed on the display as it is entered.
2) Press the bar code key 7 to leave the first display mode and enter the second display mode. The display 8 changes when the second display mode is entered. In particular, the word 'beans' is no longer displayed. Instead, predetermined start and end marks, are shown. These marks identify the display as being in the second display mode. They also mark the area the user is to fill with bar code data. The bar code display unit 61 on the display 8 will also light up, because the cursor is positioned in an area on the display 8 which is meant for bar code data.
3) Enter the digits '01234567' while in the second display mode.
4) Press either the bar code key 7 or the return key 13 to exit the second display mode. At this point, the bar code display unit 61 will no longer be lit and the display will show the following: "beans01234567—". The cursor is assigned to the first position after the bar code data and the horizontal line represents the cursor position. The bar code display unit 61 will no longer be lit because the cursor is positioned under something which cannot belong to a bar code. As the printer is no longer in the second display mode, all data now entered, be it numbers, letters or other printable symbols, will be interpreted as text data. Thus, bar codes can only be created or edited in the second display mode.
5) Enter 'M&E' to complete the label. The display now shows: "beans01234567M&E—".

Moving the cursor to discrete positions among these entered characters has the following effects:

A) beans01234567M&E. The cursor is positioned underneath a text character. The bar code display unit 61 will not light up, advising the user that this is a text character.

B) beans01234567M&E. The cursor is positioned underneath a bar code character. The bar code display unit 61 will light up, signifying that this is a bar code character. However, the user cannot edit the bar code data, because the printer is not in the second display mode. If the user were now to enter a character, it would be entered as text data, rather than as bar code data. The new character would be entered after the 's'.

C) beans01234567M&E. The cursor is positioned underneath a bar code character and so the bar code display unit 61 will again light up. If the user were now to enter a character, it would be refused by the software since one cannot mix text data with bar code data, i.e., put a text character between the '6' and the '7'.

D) beans01234567M&E. The cursor is positioned underneath a text character and so the bar code display unit 61 will not light up. If the user were to enter a character, it would be entered as text data immediately after the '7'.

E) beans01234567M&E. The bar code data is treated as a single unit when in the first display mode. In this mode, the bar code data may not be altered. The bar code data can only be modified when in the second display mode.

However, the user does not necessarily have to position the cursor underneath one of the underlined characters to enter the second display mode. This is because the printer only allows one bar code to be printed on a label. Thus, there is no confusion as to which set of bar code data the user would like to modify. As there can be no confusion, the second display mode may be entered with the cursor under any character on the display and pressing the bar code key 7. In this second display mode, the user can position the cursor as needed to modify the bar code data.

What is claimed is:

1. A printer for printing on a tape, said printer comprising:

a controller having an associated storage device;

an input device connected to said controller for entering characters comprising at least text data and bar code data, said text data and said bar code data being stored in a first area of said storage device;

a display device connected to said controller, said display device arranged to display a cursor having a cursor position, and further arranged to simultaneously display both text data and bar code data, in a first display mode;

a cursor moving device connected to said controller, said cursor moving device arranged to move the cursor on the display device, whereby the cursor is assignable to any of the displayed text data and bar code data;

a converting device associated with the controller, said converting device arranged to convert the text and bar code data into printable data;

a printing device connected to the converting device, said printing device arranged to print the printable data on the tape, and a bar code display unit associated with said display device, said bar code display unit arranged to indicate whenever the cursor is assigned to bar code data.

2. A printer according to claim 1, wherein the bar code display unit comprises a light, said light arranged to illuminate when the cursor is assigned to bar code data.

3. A printer for printing on a tape, said printer comprising:

a controller having an associated storage device;

an input device connected to said controller for entering characters comprising at least text data and bar code data, said text data and said bar code data being stored in a first area of said storage device;

a display device connected to the controller, said display device arranged to display a cursor having a cursor position, and to simultaneously display both text data and bar code data, in a first display mode;

a cursor moving device connected to said controller, said cursor moving device arranged to move the cursor on the display device, whereby the cursor is assignable to any of the displayed text data and bar code data;

a converting device associated with the controller, said converting device arranged to convert the text and bar code data into printable data;

a printing device connected to the converting device, said printing device arranged to print the printable data on the tape; and user input means arranged to switch the display device between the first display mode and a second display mode, only bar code data being displayed in the second display mode.

4. A printer according to claim 3, wherein the display device is provided with start and end marks between which bar code data is displayed in the second display mode.

5. A printer according to claim 3 further comprising a bar code key associated with the input device, said bar code key arranged to switch the display device from the first to the second display mode.

6. A printer according to claim 5, further comprising a return key, said return key arranged to switch the display device from the second to the first display mode.

7. A printer according to claim 3, wherein the controller is configured to allow bar code data to be entered, edited, or deleted only when the display device is in the second display mode.

8. A printer according to claim 7, wherein the controller is configured to save the cursor position when the display is switched from the first to the second display mode, and store bar code data entered in the second display mode in said first area along with the text data, according to the saved cursor position.

9. A printer according to claim 8, wherein the controller is configured to insert bar code data entered in the second display mode between the text data according to the saved cursor position only when no bar code data has previously been stored in the storage device.

10. A printer according to claim 3, wherein the controller is configured to restrict the input device from entering, editing or deleting data in the first display mode, when the cursor is assigned to bar code data.

11. A printer according to claim 3, wherein the controller is configured to display bar code data when the display device is switched from the first to the second display mode, regardless of the cursor position.

12. A printer according to claim 3, wherein the controller is configured to assign the cursor to the first text character following the bar code data, should such a text character be present, and to the first position after the bar code data, should a text character not be present, when the display device switched from the second display mode to the first display mode.

13. A tape printer comprising:

a controller having an associated storage device;

an input device connected to said controller for entering characters comprising at least text data and bar code data;

a display device connected to said controller, said display device arranged to display a cursor having a cursor position, and further arranged to simultaneously display both text data and bar code data, in a first display mode;

a cursor moving device connected to said controller, said cursor moving device arranged to move the cursor on the display device, whereby the cursor is assignable to any of the displayed text data and bar code data;

a converting device associated with the controller, said converting device arranged to convert the text and bar code data into printable data; and a printing device connected to the converting device, said printing device arranged to print the printable data on the tape, wherein said controller is configured to sequentially store said text data and said bar code data in a first area of said storage device, and store bar code position data in a predetermined second area of said storage device, said bar code position data indicating where the bar code data is stored in the first area.

14. A printer according to claim 13, wherein the bar code position data comprise a bar code start position and a bar code end position which respectively indicate the position of a first and a last character of the bar code data stored in the first area.

15. A printer according to claim 14, wherein the converting device is configured to read the text data and bar code data sequentially out of the storage device.

16. A printer according to claim 13, wherein the converting device is configured to read the text data and bar code data sequentially out of the storage device.

17. A printer according to claim 16, wherein the converting device is configured to determine whether a character read out of the storage device is to be printed as text or as a bar code, according to the bar code position data.

18. A printer according to claim 17, wherein the converting device is configured to compare the position of the first and last bar code character, as indicated by the bar code position data, with the position of each character as it is read out of the storage device, to determine whether a particular character is to be printed as text or as a bar code.

19. A method for inputting text and bar code data to a printing device for printing of both text and bar codes on a substrate, which method comprises:

entering data through an input device;

storing the entered data in a first area of a storage device; and displaying at least a portion of the entered data on a display device, both text and bar code data simultaneously being displayed when the display device is in a first display mode, and only bar code data being displayed when the display device is in a second display mode.

20. The method of claim 19, wherein bar code data is displayed between predetermined start and end marks in the first display mode.

21. The method of claim 19, wherein bar code data may be entered only when the display device is in the second display mode.

22. The method of claim 19 further comprising the additional step of switching from said first display mode to said second display mode, if said display device is initially in the first display mode, before the step of entering data, and then entering bar code data.

23. The method of claim 22, comprising the step of saving the cursor position before the step of switching from said first display mode to said second display mode, the entered bar code data being stored in the first area of said storage device along with previously stored text data according to the saved cursor position.

24. The method of claim 23, wherein the entered bar code data is stored according to the saved cursor position only if no bar code data had previously been stored.

25. The method of claim 23, wherein bar code data is displayed regardless of the saved cursor position.

26. The method of claim 22, further comprising the additional steps of switching back from the second display mode to the first display mode, and assigning the cursor to the first text character following the entered bar code data, should such a text character be present, and to the first position after the bar code data, should such a text character not be present.

27. The method of claim 19, wherein the step of entering data is restricted when the cursor is assigned to bar code data and the display device is in the first display mode.

28. A method for inputting text and bar code data to a printing device for printing of both text and bar codes on a substrate, which method comprises:

entering data through an input device;

storing the entered data in a first area of a storage device;

storing bar code position information in a predetermined second area in the storage device, said bar code position information indicating where bar code data is stored in the first area;

converting the entered data into printable characters; and printing the printable characters on a substrate.

29. The method of claim 28, wherein the bar code position data indicates the position of a first and a last character of the bar code data stored in the first area.

30. The method of claim 29, comprising the additional step of comparing the position of the first and last characters of bar code data to determine whether any of the entered data is to be printed out as bar code characters, said step of checking carried out before said step of converting.

31. The method of claim 29, comprising the additional step of sequentially reading out the text and bar code data as they are converted into printable characters.

32. The method of claim 29, comprising the additional step of determining whether each datum read out is to be printed as text or as a bar code, according to the bar code position data.

33. The method of claim 32, comprising the additional step of comparing the position of each datum with the position of the first and last characters of bar code data, as indicated by the bar code position data, to determine whether it is to be printed as text or as a bar code.

* * * * *

UNITED STATES PATENT AND TRADEMARK OFFICE

CERTIFICATE OF CORRECTION

PATENT NO. : 5,857,789

DATED : January 12, 1999

INVENTOR(S) : Robert Charles Lewis Day et al.

It is certified that error appears in the above-identified patent and that said Letters Patent is hereby corrected as shown below:

On the title page, Item [75]: change "Royston" to --Cambridge--.

Signed and Sealed this

Fourth Day of May, 1999

*Attest:*

*Attesting Officer*

Q. TODD DICKINSON

*Acting Commissioner of Patents and Trademarks*